United States Patent [19]

Wulff

[11] 4,186,459

[45] Feb. 5, 1980

[54] CARPET BRUSH ATTACHMENT FOR A FLOOR TREATING MACHINE

[75] Inventor: Richard F. Wulff, Maple Plain, Minn.

[73] Assignee: Advance Machine Company, Spring Park, Minn.

[21] Appl. No.: 957,014

[22] Filed: Nov. 2, 1978

[51] Int. Cl.[2] ..... A47L 11/162; A46B 13/02

[52] U.S. Cl. ..... 15/180; 15/49 R

[58] Field of Search ..... 15/18 D, 49 R, 50 R, 15/28, 29; 51/177, 170 T

[56] References Cited

U.S. PATENT DOCUMENTS

| | | | |
|---|---|---|---|
| 889,309 | 6/1908 | Jenkins, Jr. | 15/49 R |
| 1,079,298 | 11/1913 | Jenkins, Jr. | 15/49 R |
| 1,139,407 | 5/1915 | Finnell | 15/49 R |
| 3,397,419 | 8/1968 | Okun | 15/180 X |

*Primary Examiner*—Peter Feldman
*Attorney, Agent, or Firm*—Wicks & Nemer

[57] ABSTRACT

A carpet brush attachment for a floor treating machine including a circular machine supporting plate having a circular hub extending axially therefrom. The circular plate has formed adjacent the outer edge thereof and spaced from the hub an annular flange acting as a stop for a ring brush. The ring brush is formed with spaced holes through which extensions formed on the plate freely extend which rotate the brush and allow the brush to move vertically upon the extensions and thereby rest floatingly on a carpeted surface to be cleaned with the plate on the surface and supporting the machine.

6 Claims, 3 Drawing Figures

CARPET BRUSH ATTACHMENT FOR A FLOOR TREATING MACHINE

SUMMARY

The invention relates broadly to floor and carpet treating machines and more particularly to a rotary disc brush unit used in such a machine. The aforementioned type of machine is presently used to shampoo carpets and scrub and polish floors, and with the weight of the machine and brush on a carpet, excessive friction is created which requires considerable driving torque to rotate the brush. Also, the weight of the machine and brush upon carpet causes unnecessary wear of the carpet.

It is therefore an object of the invention to provide a rotatable brush unit which floats freely and vertically on the machine, the machine being supported on a carpeted surface by a machine supporting plate. With the subject invention less torque is required to rotate the brush, and the pressure of the brush upon the carpet to be treated is reduced with cleaning ability retained.

Related prior art, U.S. Pat. No. 3,397,419.

The invention will appear more clearly from the following detailed description when taken in connection with the accompanying drawings, showing by way of example a preferred embodiment of the inventive idea wherein like numerals refer to like parts throughout.

In the drawings forming part of this application:

Figure 1:
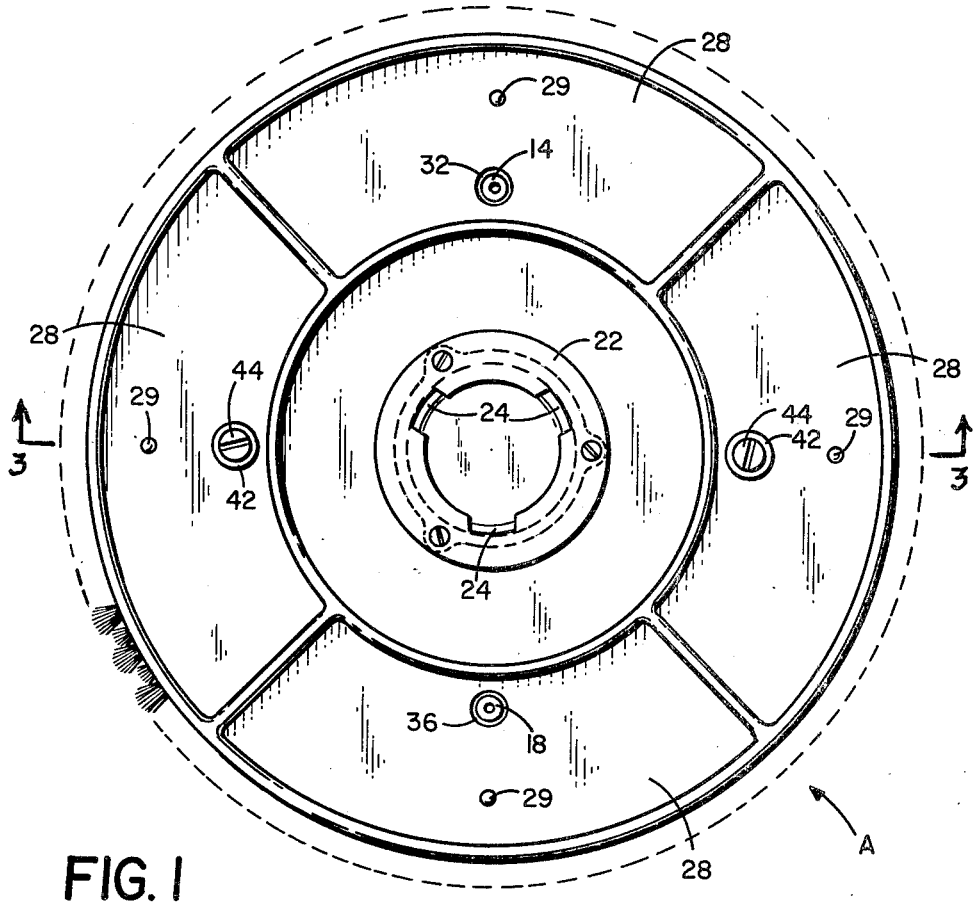
FIG. 1 is a top plan view of the carpet brush attachment embodying the invention.
Figure 3:
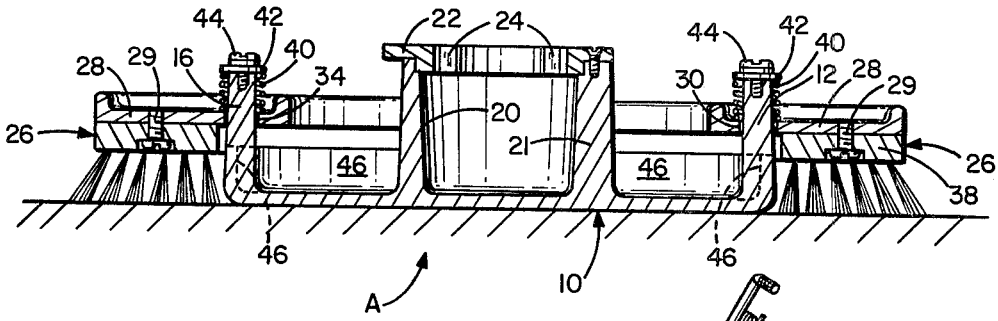
FIG. 3 is a sectional view on the line 3—3 of FIG. 1.
Figure 2:
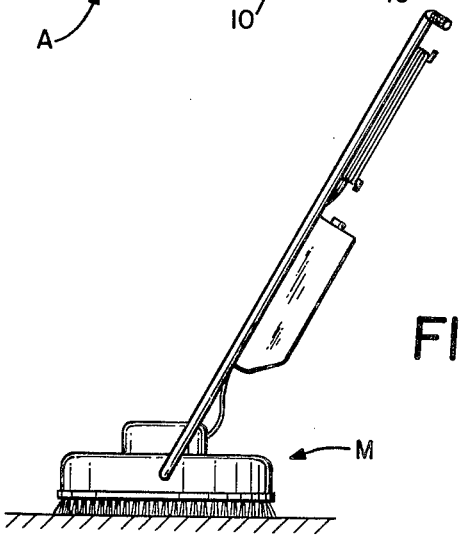
FIG. 2 is a side elevational view of a floor treating machine on which a brush unit is mounted and which embodies the invention.

Referring to the drawings in detail, the carpet brush attachment A for a floor treating machine includes the fixed circular machine supporting plate 10. The plate 10 has formed on the upper outer surface area thereof the upstanding identical spaced cylindrical extensions which form drive bosses 12, 14, 16 and 18. The bottom surface of the plate 10 is smooth for easy movement upon a carpeted surface without damage thereto and requiring less power to rotate the plate and brush over a surface. The circular plate 10 also has formed on the upper surface thereof the axial circular hub 20 formed of the annular wall 21, and secured to the top of the hub is the circular ring 22 formed with the conventional bayonet slots 24 for driving connection with conventional bayonet formations on a floor treating machine such as M.

The numeral 26 designates a carpet treating ring brush which includes the flat base ring 28. The base ring 28 has formed therethrough the spaced holes 30, 32, 34 and 36 through which the drive bosses 12, 14, 16 and 18, respectively, freely extend. The holes 30 through 36 are adjacent the inner edge of the flat base ring 28.

Secured to the underside of the base ring 28 by means of bolts 29 is the annular ring brush 38, the inside diameter of which is slightly greater than the outer radii of the drive bosses 12, 14, 16 and 18. With the brush 28 in place on the drive bosses 12 through 18, a coil spring 40 is positioned on each drive boss and interposed between the ring 28 and a washer 42, the washer secured on top of the drive boss by means of the bolt 44 in threaded engagement with the boss with the washer forming a stop. The springs 40 normally urge the brush 26 downwardly on the drive bosses and tend to hold the brush in a firm floating relation to the plate and drive bosses.

The outer edge of the circular plate 10 is formed with the upstanding annular flange 46 the upper edge thereof acting as a stop for contact with the underside of the base ring 28 thereby limiting the downward movement of the brush ring 26 when the brush hangs freely without the plate 10 upon a carpeted surface floor. The plate 28 of the brush ring contacts the upper edge of the flange 46 when the machine is lifted.

With the machine M placed on a carpeted floor, the weight of the machine is upon the plate 10 which is upon the carpet. Further, the brush 26 moves downwardly due to gravity and the urging of the springs 40. As a result of the above, the brush is floatingly positioned upon a carpeted surface to be treated free of the weight of the machine. When the hub is rotated by the machine on which it is mounted, the brush 26 is thereby rotated freely upon the carpet.

Having thus described the invention, what is claimed as new and desired to be secured by Letters Patent is:

1. A carpet brush attachment for a floor treating machine comprising:

(a) a circular surface engaging plate normally horizontally disposed and support for the machine on a surface, (b) said plate having a circular hub extending axially and vertically therefrom for connection with a source of power for rotation of said plate, (c) a multiplicity of spaced extensions formed on said circular plate adjacent the outer edge thereof and spaced radially outwardly from said circular hub and parallel to the longitudinal axis of said hub, (d) a ring brush having an inner diameter greater than the diameter of said plate and surrounding said plate, (e) said ring brush having spaced holes adjacent the inner edge thereof through which said extensions freely extend for contact of said ring brush by said extensions for rotating said ring brush when said plate is rotated and allowing said brush to move upon said extensions and rest floating by on a carpeted surface with the plate upon the surface and supporting the machine to which the brush is attached.

2. The device of claim 1 in which (a) each of said extensions has a stop on the upper end thereof, and (b) a spring interposed between the stop and said ring brush normally urging said brush downwardly relative to said plate.

3. The device of claim 2 in which said extensions are cylindrical in formation.

4. The device of claim 1 in which said extensions are cylindrical in formation.

5. The device of claim 1 in which said plate is formed with stop means for limiting the movement of said ring brush on said extensions.

6. The device of claim 5 in which said stop means is an annular flange.

* * * * *